US006702263B2

(12) United States Patent
Kelly

(10) Patent No.: US 6,702,263 B2
(45) Date of Patent: Mar. 9, 2004

(54) DIFFUSER SADDLE CONNECTION

(75) Inventor: Jeffrey T. Kelly, Carnegie, PA (US)

(73) Assignee: Red Valve Company, Inc., Carnegie, PA (US)

( * ) Notice: Subject to any disclaimer, the term of this patent is extended or adjusted under 35 U.S.C. 154(b) by 47 days.

(21) Appl. No.: 10/142,361

(22) Filed: May 9, 2002

(65) Prior Publication Data

US 2003/0006512 A1 Jan. 9, 2003

Related U.S. Application Data

(60) Provisional application No. 60/289,987, filed on May 10, 2001, now abandoned.

(51) Int. Cl.[7] ..... B01F 3/04
(52) U.S. Cl. ..... 261/122.1; 277/354; 277/504
(58) Field of Search ..... 261/122.1, 122.2; 277/345, 354, 503, 504, 585

(56) References Cited

U.S. PATENT DOCUMENTS 4,118,447 A * 10/1978 Richter ..... 261/122.1
4,426,093 A * 1/1984 Roush ..... 277/529
4,960,546 A 10/1990 Tharp
5,458,343 A * 10/1995 Dornfeld et al. ..... 277/503
5,788,847 A 8/1998 Tharp
5,846,412 A 12/1998 Tharp
5,888,391 A * 3/1999 Meshengisser et al. ..... 210/220

* cited by examiner

*Primary Examiner*—Scott Bushey
(74) *Attorney, Agent, or Firm*—The Webb Law Firm

(57) ABSTRACT

A diffuser saddle connection is used for the attachment of diffusers on submerged air laterals in systems that treat municipal and industrial waste water. A top saddle surface and a bottom saddle surface enclose a portion of a feed pipe. A spout attached to the bottom saddle surface is solvent-welded to a tee, which is threadedly engaged to a diffuser. Flexible bushings on a nipple attached to the tee relieve stress on the connection between the diffuser and the diffuser saddle connection. An open end allows water to flow into the diffuser pipe to provide hydrostatic equilibrium and to reduce buoyancy.

4 Claims, 5 Drawing Sheets

DIFFUSER SADDLE CONNECTION

CROSS REFERENCE TO RELATED APPLICATION

This application claims the benefit of U.S. Provisional Patent Application No. 60/289,987 filed May 10, 2001 now abandoned.

BACKGROUND OF THE INVENTION

1. Field of the Invention

The present invention relates in general to the aeration of waste water and more particularly to improvements in the attachment configuration of diffusers on submerged air laterals in systems that treat municipal and industrial waste water.

2. Description of the Prior Art

A variety of diffusers have been used in waste water aeration, including fine bubble diffusers, flexible membrane diffusers, dome diffusers, porous tube diffusers and coarse bubble diffusers. The fine bubble diffusers are generally more efficient in transferring oxygen to the water, but they also have relatively high maintenance requirements. The coarse bubble diffusers are primarily applicable to low maintenance systems, while intermediate bubble systems represent a compromise between efficiency and maintenance requirements.

The aeration system typically includes submerged air laterals in the treatment basin arranged in the desired configuration. In the past, flexible membrane diffusers have typically been connected with the air laterals by a direct threaded connection between the diffuser and the lateral pipe. This requires outlets in the pipe which are internally threaded so that pipe nipples connected with the diffusers can be threaded into them. The major drawback with this diffuser mounting arrangement is that the air laterals must be constructed of heavy wall piping in order to provide enough threads to hold the diffuser in a cantilever position extending to the side of the lateral pipe. The need for heavy wall piping, whether stainless steel or polyvinyl chloride (PVC) adds significantly to the overall system cost.

In addition, the diffuser is subjected to turbulence, flexing, vibration and other forces while in service, and the stress applied to the diffuser connection is considerable. Ordinarily, the flexible membrane diffuser is about two feet long and the pipe nipple which connects to the air lateral is ¾ inch in diameter. As a consequence of the fatigue that results from long term operation of the diffusers, the connections have a fairly high failure rate and the pipe nipples are actually sheared off in some cases. Diffusers more than about two feet long are not used because the stress increases with length and longer diffusers are unable to withstand the added stress.

Threaded connections are also subject to damage to the threads caused by screwing the diffusers in and out during maintenance procedures. Threads in plastic fittings can be cross threaded or otherwise damaged by the mating threads, especially if the male threads are metal. Because plastic threads are lacking in durability, the diffusers can work loose and fall out. Stress applied to the diffuser can lead to enlargement of the hole and other deformations which can create air leaks, and continued operation of the diffuser under these conditions can unscrew the diffuser and eventually result in its complete detachment from the aeration system.

Another problem with the direct threaded connection is that the diffuser is difficult if not impossible to accurately level. If the holes which are drilled and tapped in the sides of the lateral pipes are angled from a true radial orientation, the outboard end of the diffuser will be higher or lower than the inboard end. Also, if the tapped hole is rotated slightly on the pipe from a position exactly to the side, the diffuser will extend at a slight incline and the outboard end will again be too low or too high. Tolerances on the threads also cause out of level orientations of the diffusers. If the diffuser is not level, the air distribution pattern is disturbed because the outboard end either receives too little or too much air depending upon whether it is too low or too high. If diffusers extend to both sides of the pipe, one may extend down slightly and the other may extend up slightly so that an unbalanced situation results and the air distribution suffers accordingly. Units that screw into the top of the pipe are also difficult to level and have unbalanced air flow when out-of-level.

In conventional systems, it is difficult to add or relocate the diffusers because of the need for a threaded opening in the side of the pipe at each different diffuser location. The openings must be made at the factory and cannot be made adequately in the field. Moreover, when the threads are fully tightened, the diffuser is not necessarily located with its bottom side facing downwardly as required for proper diffusion of the air. Thus, if the diffuser is to be properly oriented, it must often be either over-tightened or under-tightened, neither of which is desirable. Overtightening can strip the threads or damage another part of the assembly, while under-tightening raises the possibility of the diffuser working itself loose and falling off of the air lateral due to vibrational forces or other forces applied to it in service. Units that require welded fittings are subject to similar problems.

Systems in which the diffusers connect directly to the sides of the lateral pipes necessarily locate the outlets on the horizontal center line of each pipe. When a large pipe four inches in diameter or more is used, the water is blown out only down to the level of the outlets. Consequently, separate water purge systems are needed to pump water out of the bottom half of the pipe in order for the aeration system to operate properly with minimum head loss. Such purge requirements add to the cost and complexity of the overall aeration system.

Tube type membrane diffusers are fully buoyant in that the entire diffuser is filled with air during normal operation. Although the fully buoyant system is easy and economical to produce, it also results in maximum stress being applied to the diffuser because the buoyant force on the diffuser is a function of the amount of water displacement which in turn depends upon the volume of the diffuser that is occupied by air. Therefore, in at least some applications, it is desirable to reduce the volume within the diffuser that is occupied by air in order to reduce the buoyancy stress to which the diffuser is subjected.

Coarse bubble diffusers are typically constructed of stainless steel, and they are often installed on stainless steel piping. Stainless steel diffusers and pipes are more costly than PVC and other plastics, and plastics are also less susceptible to corrosion problems. Again, direct threaded connections are sometimes used between the pipe and the pipe nipple of the diffuser, and this type of connection is lacking in structural strength. Adding or relocating diffuser units is difficult because the female outlet couplings must be factory welded to the stainless steel pipe. Leveling of the diffusers is also a problem caused by the manner in which they are connected to the air laterals.

In the past, various types of saddles have been proposed for effecting an outlet from an air header pipe. The known saddles that are constructed from PVC are solvent welded onto the top of the pipe with the saddles facing upwardly and having threaded outlets. Special flat plate diffusers are screwed directly into these outlets. Due to the solvent weld required to connect the saddle to the pipe, this type of saddle can be used only with PVC pipe and not with stainless steel or many other materials. Thus, when a particular application calls for stainless steel pipe, the saddles cannot be used. It is common for stainless steel straps to be used to secure the saddle, even when a glue connection is provided.

Conventional coarse bubble diffuser systems require an orifice between the air lateral and the diffuser in order to provide a pressure differential that prevents downstream diffusers from being deprived of significant air flow. The orifice is normally located in the inlet to the diffuser where it is subject to becoming clogged when the air is discontinued and waste water backs up into the diffuser. Solids that flow back through the orifice can become trapped and considerable amounts of debris can accumulate and cause flow disruptions.

SUMMARY OF THE INVENTION

The present invention is directed toward a diffuser mounting arrangement that avoids the problems associated with prior systems. In accordance with the invention, a saddle has two mating sections that hook together along one edge and may be secured along the other edge by a special fastener. One saddle section has an outlet spout in which a non-threaded nipple may be solvent welded. The other end of the nipple may be similarly attached, by a non-threaded, solvent-welded connection, to a tee or elbow fitting. The tee or elbow fitting in turn connects with one or more diffusers by a connection to a threaded nipple. A reducer bushing in the tee or elbow fitting is used if the tee or elbow fitting lacks threads or differs in diameter from the threaded nipple. The threaded nipple is received within the diffuser by a threaded nipple bushing. The nipple bushing is circumferentially housed within a ring bushing which is distally restrained by a flow control bushing and is proximally restrained by a disc bushing. Distortion in the ring bushing, flow control bushing and disc bushing allow limited deflection of the diffuser at an angle from the longitudinal axis of the threaded nipple and the nipple bushing. This internal deflection bushing system allows the diffuser to deflect under significant end loads without compromising the structural integrity of the diffuser mounting arrangement. The deflection bushing system allows the use of threaded connections between diffusers and threaded nipples without subjecting them to the stresses characteristic of prior art systems. The diffusers are configured to reduce stress on the diffuser mounting arrangement. The distal end of the diffuser is open to allow the flow of water into the diffuser pipe to provide hydrostatic equilibrium and to reduce buoyancy.

Another advantage of the present invention is that the saddle assembly does not have to be removed to replace the elastomer membrane during maintenance. If an O-ring or elastomer is used in the saddle, the removal of the saddle releases the internal O-ring from its compressed state and, when the assembly is reconnected, leakage may result around the seal. The diffuser mounting arrangement of the present invention allows for removal and replacement of a single diffuser without the removal of the saddle.

Also, the connection of the present invention uses reducer bushings within the tee sockets to increase the strength of the connection. Threaded connections at the diffusers have eliminated the need for a threaded bushing at the connection between a tee and a discharge spout of the saddle.

DETAILED DESCRIPTION OF THE PREFERRED EMBODIMENTS

Figure 1:
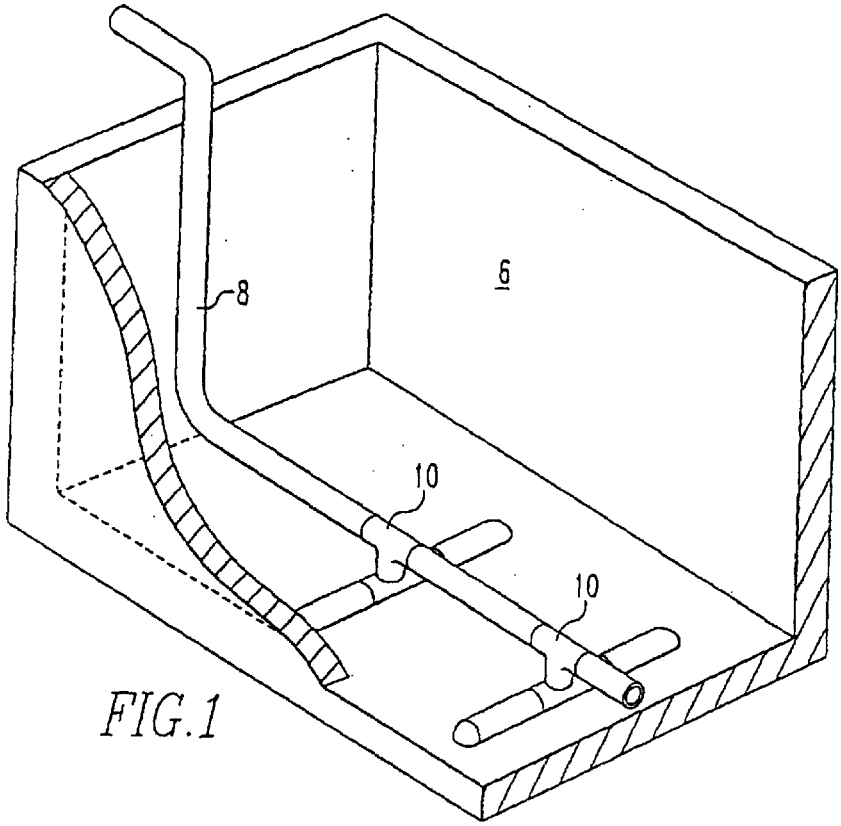
FIG. 1 is a cutaway perspective view showing a waste water treatment basin equipped with an aeration system in which a feed pipe is connected by diffuser saddle connections to tube type diffusers according to the present invention.

Referring now to the drawings in more detail and initially to FIG. 1, the present invention relates to a system for effecting the aeration of waste water contained in a basin 6. The basin shown is rectangular in shape, having a floor and walls, but the invention may be used in systems or basins with other configurations.

In order to aerate the waste water contained in the basin 6, compressed air is supplied to a feed pipe 8. The feed pipe 8 feeds, either sequentially or through an arrangement of branching or lateral pipes, compressed air to one or more diffuser saddle connections 10. The portion of feed pipe 8 joined with a diffuser saddle connection 10 is submerged in basin 6.

Figure 2:
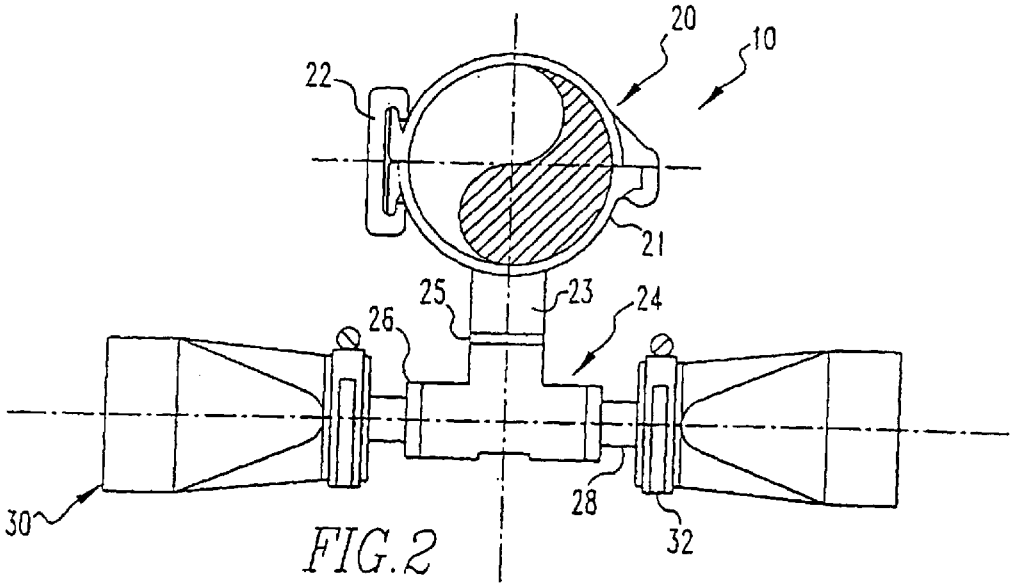
FIG. 2 is an elevation view (in partial cross-section) of the diffuser saddle connection of the present invention in connection with coarse bubble diffusers.

With reference to FIG. 2, each of the diffuser saddle connections 10 includes a pair of mating saddle sections, a top saddle section 20 and a bottom saddle section 21. The two saddle sections 20 and 21 cooperate to form a cylinder having an inside diameter substantially equal to the outside diameter of the corresponding portion of feed pipe or lateral pipe 8. Consequently, the two saddle sections 20 and 21 fit closely on feed pipe 8 and enclose a portion of the length of feed pipe 8 when assembled. The two saddle sections 20 and 21 are configured to engage and have corresponding protrusions onto which a clip 22 fastens so that the two saddle sections 20 and 21 are secured about feed pipe 8. Lower saddle section 21 is provided with a spout 23 which, when aligned with an opening in feed pipe 8, allows compressed air to pass from the feed pipe to an arm of a tee 24, which is attached by a solvent weld connection 25 to spout 23. The tee 24 is therefore in fluid communication with the interior of feed pipe 8.

One or more of the remaining arms of tee 24 serve as outlets allowing the outward passage of compressed air for aeration purposes; an arm not used may be capped or plugged. The preferred orientation of tee 24 is the orientation in which the outlets are axially aligned (see FIG. 2). Alternatively, an L-shaped or flexible connector with one arm available for the outward passage of compressed air may be substituted for tee 24.

A reducer bushing 26 is fitted into each arm of tee 24 from which air is to exit the tee. Reducer bushing 26 is connected to a nipple 28, and compressed air flows through reducer bushing 26 and nipple 28 into a diffuser 30. Nipple 28 is thus in fluid communication with tee 24. Diffuser 30 may be formed in any of a number of configurations known to those in the art; the configuration shown in FIG. 2 is a coarse bubble diffuser. FIG. 2 shows the use of a band clamp 32 to fasten diffuser 30 onto nipple 28.

Figure 3:
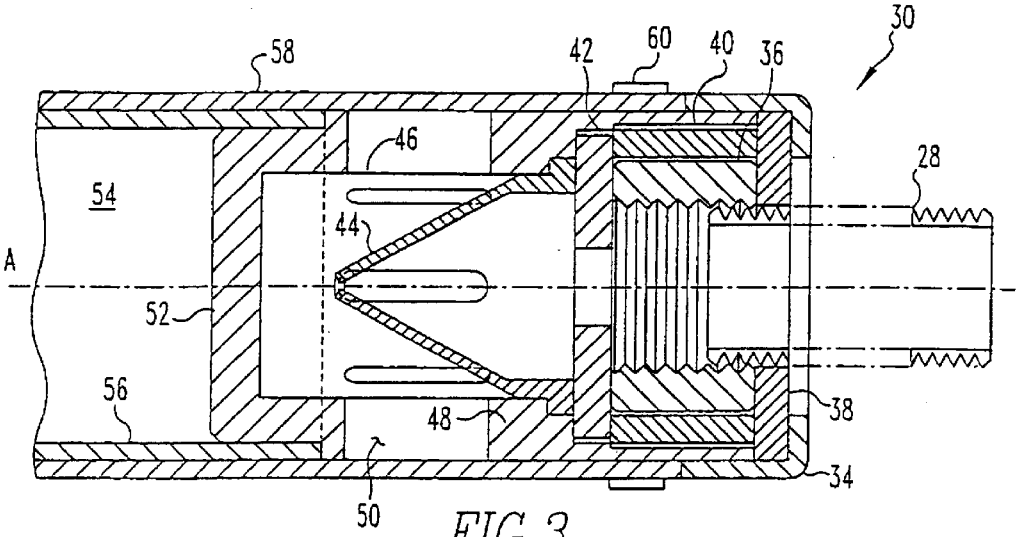
FIG. 3 is a sectional view of a connection portion of a tube type diffuser of the present invention.

With reference to FIG. 3, nipple 28 is threaded at the end at which it is received by diffuser 30. Diffuser 30 is terminated at the end proximal to nipple 28 by a proximal end cap 34 with an opening to receive nipple 28. Nipple 28 and diffuser 30 have a common longitudinal axis A. Nipple 28 is threaded, and is threadedly received within diffuser 30 by a threaded nipple bushing 36, held within diffuser 30 by proximal end cap 34. A disc bushing 38, receiving nipple 28, is disposed between proximal end cap 34 and threaded nipple bushing 36. A ring bushing 40 is disposed circumferentially around threaded nipple bushing 36. A flow control bushing 42 abuts the distal end of nipple 28 when nipple 28 is fully threaded into threaded nipple bushing 36. Flow control bushing 42 contains a central opening through which compressed air may pass.

Figure 7:
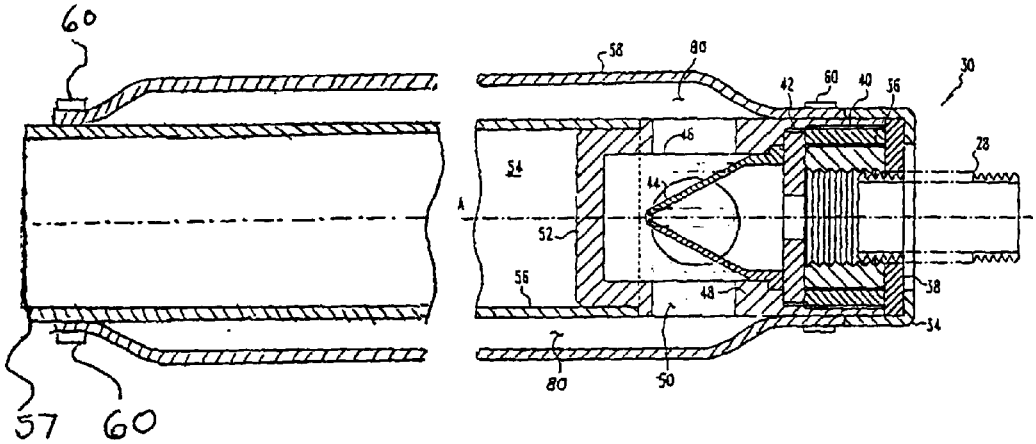
FIG. 7 is a sectional view of a tube type diffuser according to the invention, with an open end.

A micro check valve 44 distally abuts flow control bushing 42. In a preferred configuration, micro check valve 44 is V-shaped or conical in shape, with the vertex located distally from flow control bushing 42. A small opening at the vertex of micro check valve 44 allows the passage of compressed air while preventing the backflow of sludge or suspended solids towards flow control bushing 42. An air distribution bushing 46 is cylindrical in shape and is disposed circumferentially to micro check valve 44. An assembly bushing 48 is arranged circumferentially to a proximal portion of air distribution bushing 46, to flow control bushing 42, and to ring bushing 40, and serves to hold these parts in position on assembly of diffuser 30. Air distribution bushing 46 contains openings to allow the passage of compressed air into air ports 50 disposed circumferentially around air distribution bushing 46. A bushing cap 52 is seated against the distal end of air distribution bushing 46. In some configurations, assembly bushing 48 and bushing cap 52 may constitute a single piece. A chamber 54, disposed around longitudinal axis A and located distally from bushing cap 52, may be partially or entirely filled with liquid to provide hydrostatic equilibrium and to reduce buoyancy of the diffuser 30. A diffuser pipe 56 is disposed around longitudinal axis A and defines the circumferential extent of chamber 54. Referring to FIG. 7, in a preferred embodiment of the invention, the distal end 57 of diffuser pipe 56 is open to allow the flow of water into diffuser pipe 56 to provide hydrostatic equilibrium and to reduce buoyancy. A diffuser membrane sleeve 58, composed of rubber, a synthetic elastomer or another suitable material, is disposed circumferentially about the exterior of diffuser pipe 56. Diffuser pipe 56 provides support for diffuser membrane sleeve 58. Compressed air passing into air ports 50 expands membrane sleeve 58 circumferentially around longitudinal axis A, creating a passage between diffuser pipe 56 and diffuser membrane sleeve 58. Pores in diffuser membrane sleeve 58 allow the passage of compressed air to the exterior of diffuser 30, where the compressed air is discharged as bubbles into the waste water surrounding diffuser 30. A band clamp 60 or other suitable means is disposed circumferentially around diffuser membrane sleeve 58 and secures it to assembly bushing 48. Diffuser membrane sleeve 58 is flexible and may be removed and replaced when band clamp 60 and any other fastening means are removed.

Figure 4:
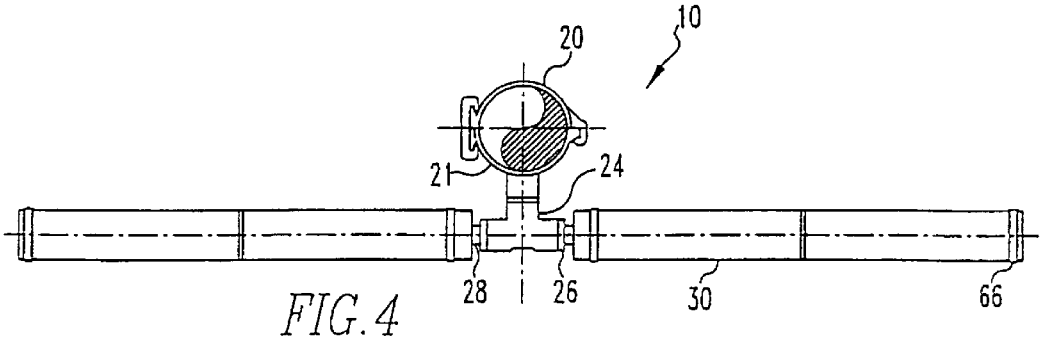
FIG. 4 is an elevation view (in partial cross-section) of the diffuser saddle connection and tube type diffusers of the present invention.

With reference to FIG. 4, the relationship of diffuser saddle connection 10, top saddle section 20, bottom saddle section 21, tee 24, reducer bushing 26 and nipple 28 are shown. A distal band clamp 66 or other suitable means is disposed circumferentially around diffuser membrane sleeve 58 at its distal end and secures it to diffuser pipe 56. The removal of distal band clamp 66 and any other fastening means enables the removal and replacement of diffuser membrane sleeve 58. Elongate diffusers 30 are shown extending horizontally in opposite directions from the outlets of tee 24.

Figure 5:
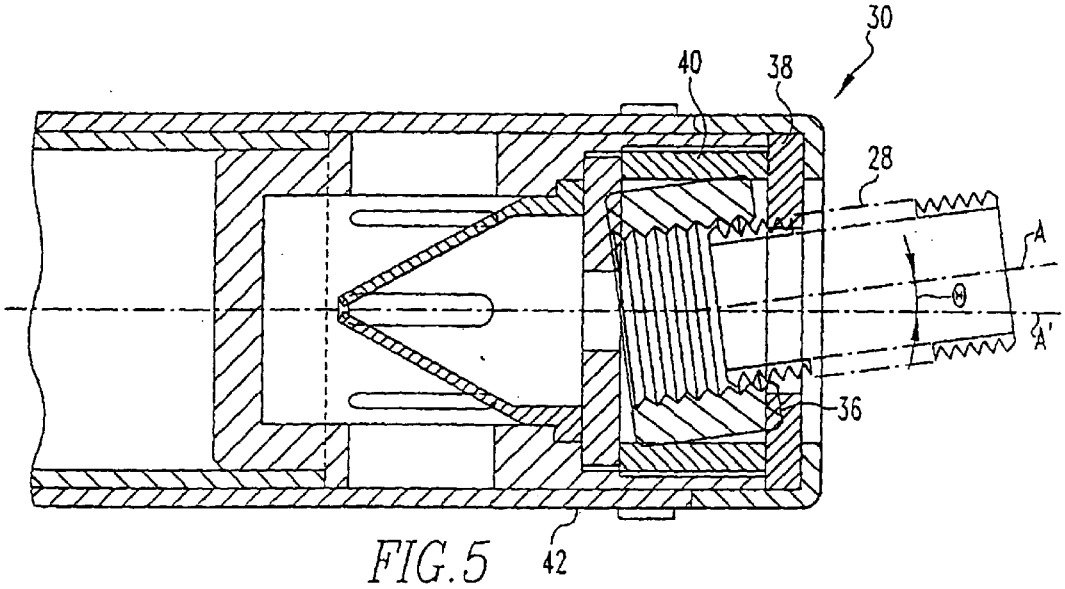
FIG. 5 is a sectional view of a diffuser connection of the present invention showing deflection under stress.

With reference to FIG. 5, diffuser 30 is depicted in a situation in which a stress is applied to diffuser 30 at an angle approximately perpendicular to longitudinal axis A. The result is a deflection of diffuser 30 so that its longitudinal axis, indicated by A', forms an angle θ with longitudinal axis A of nipple 28. Nipple bushing 36, being threadedly connected to nipple 28, remains disposed about axis A. Disc bushing 38, ring bushing 40 and flow control bushing 42 are constructed of a flexible material such as polyurethane or neoprene so that they are singly, or in concert, able to deform while maintaining a seal around nipple bushing 36. The impact bushing system of nipple bushing 36, disc bushing 38, ring bushing 40 and flow control bushing 42 resists breakage of the diffuser from loads and impacts occurring at the distal end of the diffuser, which may be cantilevered. The impact bushing system can accommodate a deflection of approximately $\theta=7.5°$.

Figure 6:
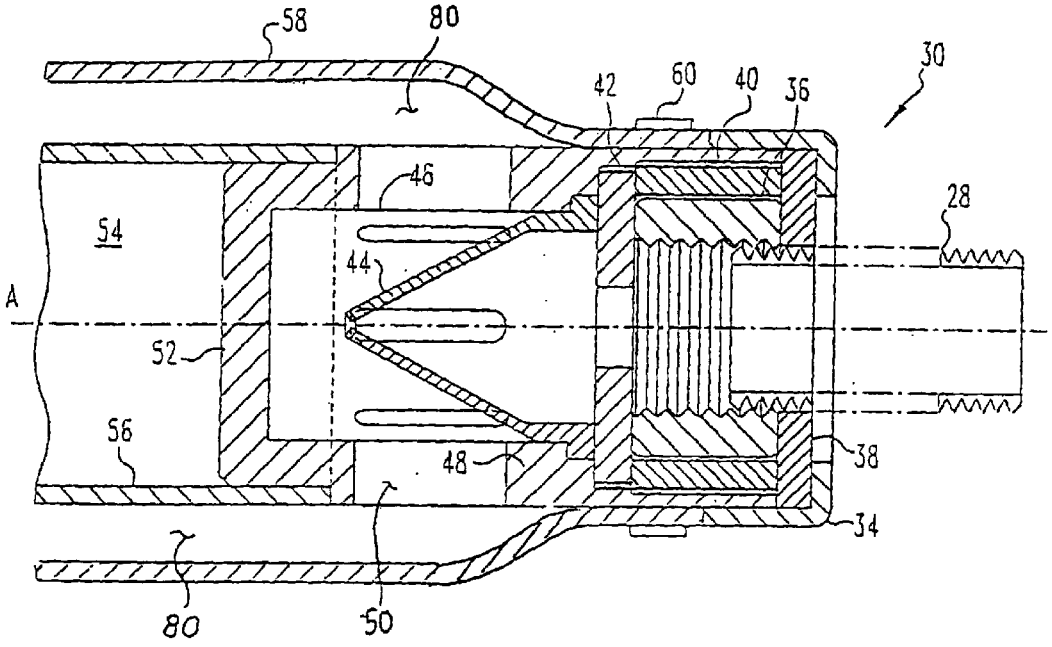
FIG. 6 is a sectional view of the diffuser connection of FIG. 3 showing the membrane in an expanded state in use.

With reference to FIG. 6, the passage of compressed air through an elongate diffuser in operation is shown. Compressed air passes through reducer bushing 26, nipple 28, through the central opening in flow control bushing 42, the opening in micro check valve 44 and into air port 50. An expanded membrane chamber 80 is formed circumferentially around longitudinal axis A between diffuser pipe 56 and diffuser membrane sleeve 58 by the expansion of diffuser membrane sleeve 58 under the influence of compressed air. Air then passes through diffuser membrane sleeve 58.

Having described the currently preferred embodiment of the present invention, it is to be understood that the invention may be otherwise embodied within the scope of the appended claims.

What is claimed is:

1. A diffuser connection, comprising:

a threaded nipple, having a longitudinal axis A;

a threaded nipple bushing, threadedly engaged to the threaded nipple; and a diffuser, having a longitudinal axis A', connected to the threaded nipple and housing a resilient bushing, wherein stress applied at an angle to the axis of the diffuser results in a deformation of the resilient bushing.

2. The diffuser connection of claim 1, further comprising a check valve abutting said resilient bushing.

3. The diffuser connection of claim 2, wherein the diffuser accommodates a volume of liquid for hydrostatic equilibrium.

4. A diffuser connection, comprising:

a nipple having a proximal end, a distal end and a longitudinal axis A;

a threaded nipple bushing, threadedly engaged to said nipple;

a resilient flow control bushing, distal to the nipple, receiving flow from the nipple, having a longitudinal axis A';

a resilient ring bushing, disposed circumferentially around the threaded nipple bushing, having a longitudinal axis A'; and a resilient disc bushing, receiving the nipple, proximal to the threaded nipple bushing, having a longitudinal axis A', wherein the flow control bushing, ring bushing and disc bushing form, in combination, a resilient seat remaining leak tight around the nipple and threaded nipple bushing upon the exertion of stresses altering the angle between A and A'.

* * * * *